US008284113B2

(12) United States Patent
Pintos et al.

(10) Patent No.: US 8,284,113 B2
(45) Date of Patent: Oct. 9, 2012

(54) WIDEBAND ANTENNAS

(75) Inventors: Jean-François Pintos, Bourgbarre (FR); Philippe Chambelin, Chateaugiron (FR); Ali Louzir, Rennes (FR)

(73) Assignee: Thomson Licensing, Boulogne, Billancourt (FR)

( * ) Notice: Subject to any disclaimer, the term of this patent is extended or adjusted under 35 U.S.C. 154(b) by 331 days.

(21) Appl. No.: 12/156,882

(22) Filed: Jun. 5, 2008

(65) Prior Publication Data

US 2009/0002251 A1 Jan. 1, 2009

(30) Foreign Application Priority Data

Jun. 6, 2007 (FR) ..... 07 55502

(51) Int. Cl.
*H01Q 9/28* (2006.01)
*H01Q 9/16* (2006.01)

(52) U.S. Cl. ..... 343/795; 343/793

(58) Field of Classification Search ..... 343/795, 343/793, 794, 700 MS, 767
See application file for complete search history.

(56) References Cited

U.S. PATENT DOCUMENTS

| | | | | |
|---|---|---|---|---|
| 4,825,220 | A | 4/1989 | Edward et al. | |
| 6,018,324 | A | 1/2000 | Kitchener | |
| 6,342,866 | B1 * | 1/2002 | Ho et al. | 343/795 |
| 7,271,779 | B2 * | 9/2007 | Hertel | 343/795 |
| 7,397,439 | B2 * | 7/2008 | Kanno et al. | 343/767 |
| 2003/0034932 | A1 * | 2/2003 | Huebner et al. | 343/795 |
| 2004/0217912 | A1 * | 11/2004 | Mohammadian | 343/795 |

FOREIGN PATENT DOCUMENTS

| | | |
|---|---|---|
| EP | 0516440 | 8/1992 |
| WO | WO 2005/122332 | 12/2005 |
| WO | WO 2006018567 A1 * | 2/2006 |

OTHER PUBLICATIONS

Schantz, Hans Gregory, Glenn Wolenec and Edward Mickel Myszka III, Frequency Notched UWB Antennas, The Proceedings of the 2003 IEEE UWBST Conference, IEEE, 2003.*
French Search Report dated Jan. 10, 2008.

* cited by examiner

*Primary Examiner* — Douglas W Owens
*Assistant Examiner* — Jennifer F Hu
(74) *Attorney, Agent, or Firm* — Jeffrey D. Carter

(57) ABSTRACT

The invention relates to a dipole type wideband antenna comprising a substrate presenting two faces, a first conductive arm, a second conductive arm placed on the substrate, a feeder line supplying the second arm passing under the first arm, In this case, the feeder line extending by a line element placed under the second arm, this element being dimensioned to filter a given frequency.

8 Claims, 2 Drawing Sheets

WIDEBAND ANTENNAS

This application claims the benefit, under 35 U.S.C. §119 of European Patent Application No. 0755502, filed Jun. 6, 2007.

BACKGROUND OF THE INVENTION

The present invention relates to an improvement of wideband antennas with omni-directional radiation, more particularly of antennas of the type described in the patent application WO2005/122332 in the name of the applicant. Antennas of this type are used to receive and/or transmit electromagnetic signals that can be used in the wireless high bit rate communications field, more particularly in the case of wideband pulse regime transmissions of UWB (Ultra Wide Band) type. Such communications are, for example, of types WLAN, WPAN, WBAN (Wireless Local/Personal/Body Area Network).

In pulse regime, the information is sent in a pulse train, for example very short pulses in the order of a nanosecond. This results in a very wide band of frequencies.

Ultra Wideband transmissions, originally reserved for military radar applications, are gradually being introduced into the domain of civil telecommunications. Hence, the frequency band [3.1; 10.6] GHz was recently adopted by the American FCC body to enable the development of UWB communication applications for which the standard is currently being constructed.

Many applications require isotropic antennas, that is with a symmetry of revolution in the radiation pattern. This is particularly the case for applications in which portable products are used, which theoretically have no special fixed position and which must communicate via a UWB wireless link with a point of access. Here, for example products of the type Video Lyra, mobile PCs, etc. are involved. This is also the case for fixed point-to-point applications for which a permanent link is required to be provided in order to obtain a certain quality of (QoS). Indeed, person(s) moving can break the beam between two highly directive antennas and it is preferable to use omni-directional antennas for transmission and/or reception. Here, for example, a video server communicating with a high definition television receiver is involved.

One of the most well known omni-directional antennas is the dipole. As shown on FIG. 1, a dipole comprises two identical arms 101 and 102 of length $\lambda/4$ placed opposite each other and differentially supplied by a generator 103. This type of radiating element has been thoroughly studied and used from the beginnings of electromagnetism, mainly for its simplicity of implementation but especially for the simplicity of the mathematic expressions governing its electromagnetic mechanism. Chapter 5 of "Antennas" by J. D. Kraus, Second Edition, Mac Graw Hill, 1988, contains the mathematical expressions explaining the mechanism of this type of radiating element. In particular, the long distance radiated field is maximum in the midperpendicular plane of the dipole (plane xOz in FIG. 1), and its theoretical impedance is around 75Ω. It was originally used in wireline technology for diverse applications such as amateur radio, UHF reception and even more recently in the wireless networks of the WLAN type. Since the advent of printed circuits, its realization has been simplified still further, the antenna now becoming an integral part of the circuit.

The problem related to this type of radiating element is on the one hand its small bandwidth and on the other its supply, which generally disturbs the symmetry of the structure. This leads to a disymmetrization of the near fields and results in a degradation of the far field pattern. Consequently, this is no longer as omni-directional. On the other hand, this type of antenna presents a small bandwidth.

To overcome these disadvantages, the patent application WO 2005/122332 proposes an antenna topology enabling an ultra wide band operation with an omni-directional radiation pattern. This antenna which will be described in more detail hereafter is comprised of two conductive arms placed on a substrate, one of the arms being supplied by a line passing under the other arm and forming a stripline structure.

However, the regulation bodies having imposed extremely low levels for the UWB terminals in the WiFi frequency bands between 4.92 and 5.86 GHz, it is necessary to integrate a filtering structure to this type of antenna. The filtering structures generally proposed are constituted of line-slots realized in the conductor arm(s), as described for example in the patent U.S. Pat. No. 7,061,442. However, the rejection rate as well as the bandwidth are insufficient.

SUMMARY OF THE INVENTION

This invention therefore proposes to integrate another type of filtering structure into an ultra wideband antenna of the type described in the patent application WO 2005/122332 that does not modify the shape factor or the chosen technology and retains the main radio-electric advantages of the reference antenna.

Hence, the present invention relates to a wideband dipole type antenna comprising a substrate presenting two faces, a first conductor arm, a second conductor arm placed on the substrate, a feeder line supplying the second arm passing under the first arm, characterized in that the feeder line extends by a line element placed under the second arm, this element being dimensioned to filter a given frequency.

The length of the line element is generally of the order of $\lambda g/2$ where $\lambda g$ is the guided wavelength in the line for the frequency band to reject.

In this case as explained in more detail hereafter, the feeder line is not connected either to the first or the second arm, the supply being realized by an electromagnetic type coupling.

In one embodiment, the first arm is formed by two conductive elements of identical geometry placed opposite each other on the two faces of the substrate. In this case, the feeder line is placed between the two conductive elements forming a stripline structure.

Within the context of the invention, the feeder line can also be realized by a microstrip line passing below the first conductor arm comprised of a sole conductor element realized on a substrate face, the microstrip line being realized on the other face of the substrate. The second conductor arm can be formed either from a single conductive element realized on the same substrate face as the first arm or formed from two conductive elements of identical geometry placed opposite each other on the two faces of the substrate.

According to an embodiment of the invention, when the conductive arms are constituted by two conductive elements on opposite sides, the two conductive elements are connected by holes made to pass through the substrate and filled with conductive material. This characteristic enables the avoidance of the leaks generated by the feeder line in the form of a surface wave in the substrate.

Preferably, the holes are made on the periphery of the conductive elements. This characteristic enables both parts of the conductive elements, which are opposite each other, to have the same potential.

SUMMARY OF THE DRAWINGS

Other characteristics and advantages of the present invention will emerge on reading the description of different embodiments, the description being made with reference to the annexed drawings wherein.

DESCRIPTION OF PREFERRED EMBODIMENT

Figure 1:
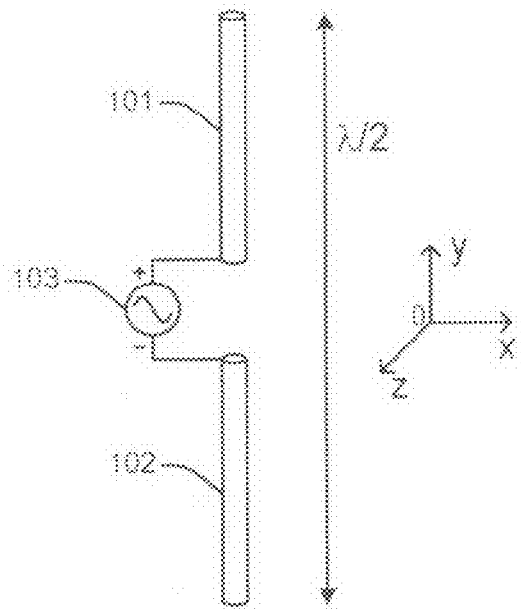
FIG. 1 already described, is a conceptual diagram of a dipole.
Figure 2:
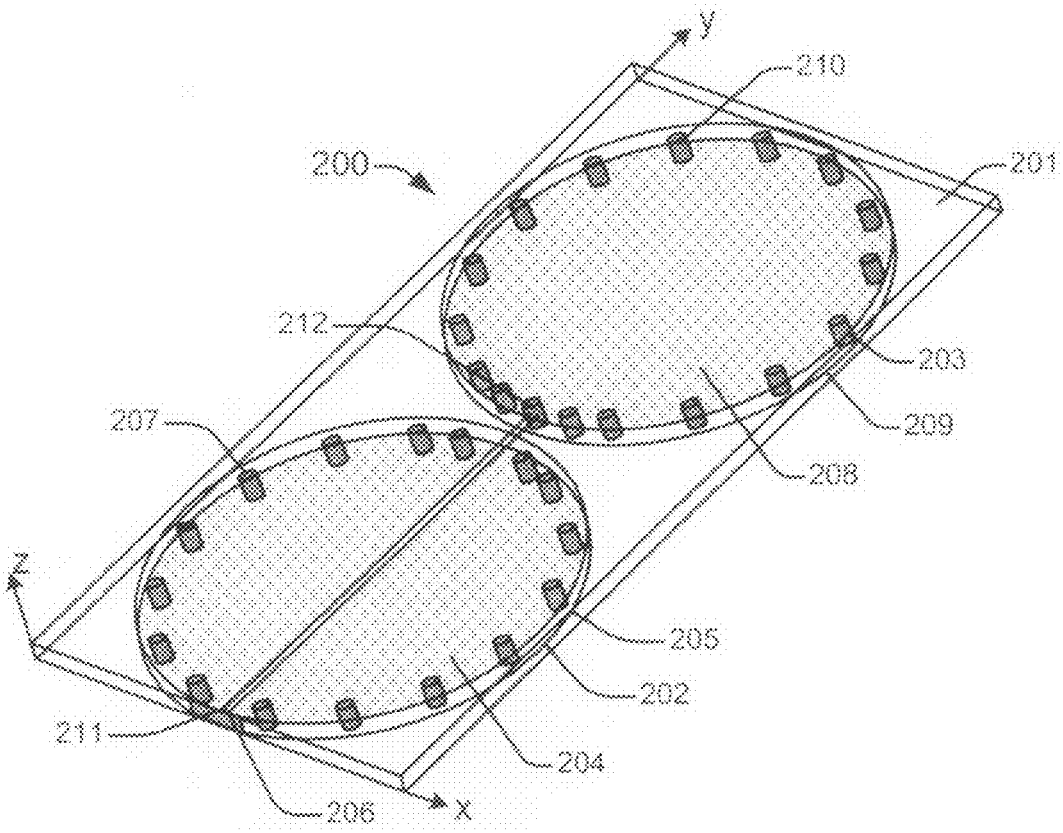
FIG. 2 is a perspective view of an antenna according to an embodiment described in the patent application WO 2005/122332.

With reference to FIG. 2, an embodiment of a wideband antenna with omni-directional radiation compliant with the present invention will first be described.

As shown in FIG. 2, the antenna 200 comprises two arms 202 and 203 that constitute a dipole. These arms, respectively 202 and 203, each include two circular conductive elements, respectively 204 and 205 and 208 and 209. The circular conductive elements are placed opposite each other in pairs on a substrate 201. For example, they can be etched, laid, glued, printed on the substrate 201. The conductive elements are realized with metal materials such as copper. It is also possible to use a plastic material (like "dibbon"), the faces of which are metallized with aluminium, for example, or metallized foam.

The substrate 201 can be realized in various flexible or rigid materials. It can be constituted by a flexible or rigid printed circuit plate or by any other dielectric material: a glass plate, a plastic plate, etc. According to the embodiment of FIG. 2, the conductive elements are connected by metallized holes 207 and 210.

The supply of the dipole is realized by a first contact 211 at the level of the first arm 202 and by a second contact 212 at the level of the second arm 203. The second contact 212 is connected to a generator using a buried line 206 passing under the first arm 202 between the two conductive elements 204 and 205. In fact the substrate consists of two plates linked together in such a way to obtain a stripline structure. The generator normally belongs to an RF circuit from which the energy is brought to the antenna. The line 206 is therefore a strip line.

The present invention relates to the integration of a filtering element with an antenna of the type described above. As shown diagrammatically in FIG. 3, the antenna comprises a first conductive arm 301 that can be realized as the first conductive arm 202 with two opposite elements but also by a single element in the case of a structure with microstrip technology. The antenna also comprises a second conductive arm 303 that is realized the same way as the first arm. The arms are supplied by a feeder line 306, passing under the first arm.

Figure 3:
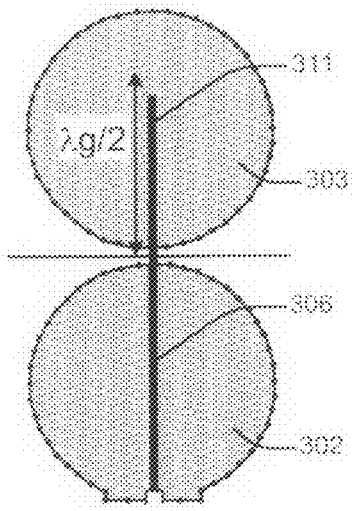
FIG. 3 is a diagrammatic top view of an embodiment of the present invention.

As shown diagrammatically in FIG. 3, the filtering element consists of a line element 311 that extends the line 306 under the second arm 303. In this case, the feeder line is not connected at the level of the arms, as in the prior art. The length of this line element 311 is chosen to be noticeably equal to $\lambda g/2$ where $\lambda g$ is the guided wavelength for the frequency band to reject. In fact, in the standard manner, those skilled in the art seek to optimize the coupling function obtained using a quarterwave to satisfy the relationship Hm^Es. In the invention, this concept is used in reverse when seeking a non-coupling function, by dimensioning the line length beyond the line-slot transition so that it is in the order of $\lambda g/2$.

Figure 4:
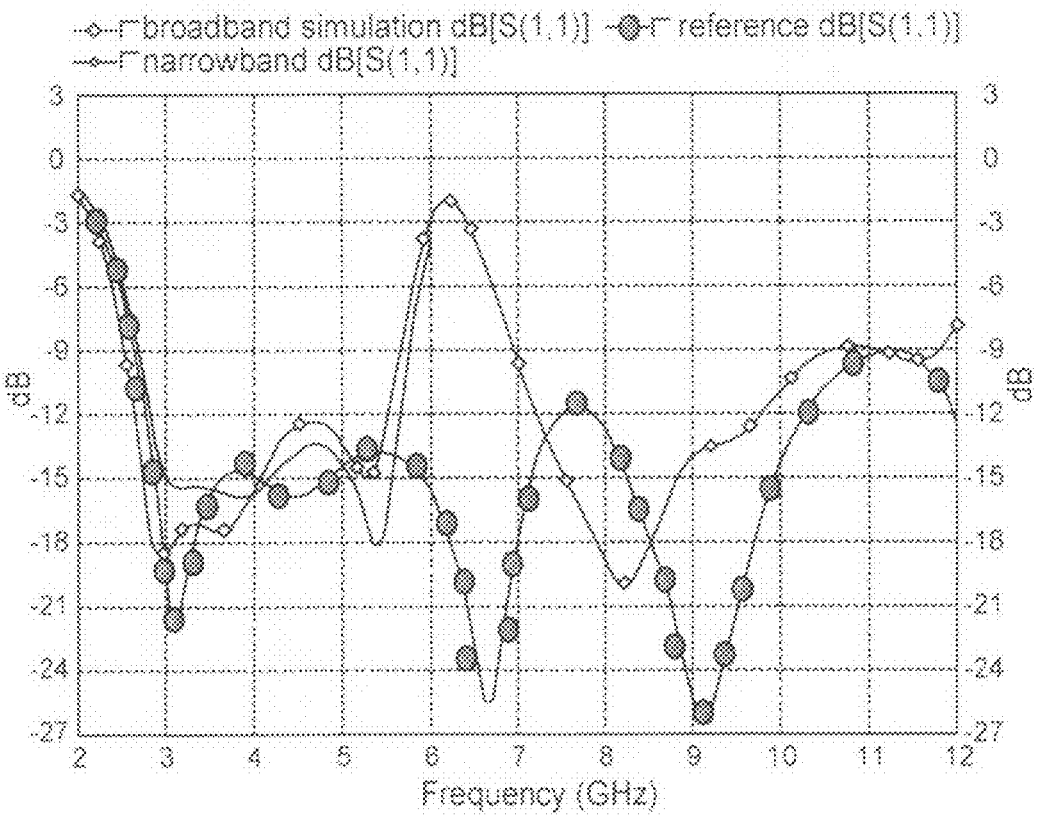
FIG. 4 represents the curves indicating the efficiency of the antenna of FIG. 3 in respect of the antenna of FIG. 2.

To simulate the results obtained, an antenna as shown in FIG. 3 was realized by using two arms each one comprising two circular conductive elements of diameter 19.5 mm etched opposite each other on the two faces of a substrate of type FR4 of relative permittivity $\in_r$=4.4 and height h=1 mm. These arms are separated by a distance d=1 mm. The facing conductive elements are connected in pairs by metallized holes. The width of the feeder line is 0.4 mm. This line is realized between the two substrates "inside" the first arm and does not comprise a metallized via that connects it to the second arm. According to the invention, this line extends "inside" the second arm to form a filtering element. This structure is simulated using electromagnetic software HFSS (Ansoft) and IE3D (Zeland). The results of the simulation made with the IE3D software are given on FIG. 4 by comparing the results obtained with the antenna of FIG. 2 and those of FIG. 3. On this figure, a filtering appears around the frequency band of 6 GHz.

The phenomenon can be explained in the following manner, the dipole is deemed to be excited by the magnetic coupling via a stripline-slot line transition. The slot line flares out gradually according to a more or less circular profile from the crossing point with the stripline. Those skilled in the art know (by analogy with the Knorr microstripline-slotline transition) that for this transition, the coupling is proportional to the vector product Hm^Es where Hm is the magnetic field of the microstrip line and Es is the electric field in the slot. These field values are taken in the coupling zone (at the crossing point). Hence, the open circuit terminating the stripline brings about at the intersection point, an open circuit and so a null Hm (non-coupling condition) field at a frequency for which the extension of the stripline beyond the crossing point is equal to a guided half-wavelength. Apart from this condition, the coupling conditions are possible and the dipole is excited over a wide frequency band.

The invention is not limited to the embodiments described and those skilled in the art will recognize the existence of diverse embodiment variants. Hence, the conductive elements can be not only circular but also of elliptical shape with a vertical or horizontal main axis. The technology that can be used, is not only stripline technology as described in the examples above but also microstrip technology.

What is claimed is:

1. A wideband dipole type antenna comprising a substrate presenting first and second faces, a first conductor arm and a second conductor arm placed on the first face of the substrate, a feeder line supplying the first and second conductor arms by electromagnetic coupling, the feeder line extending from a transition point to a feed circuit by passing under the first conductor arm, wherein the antenna includes a filtering means formed by a line element that extends the feeder line beyond the transition point between the first conductor arm and the second conductor arm and is placed under the second conductor arm, the line element having a length of $\lambda g/2$ where $\lambda g$ is a wavelength guided in the line element for a frequency band to reject.

2. The antenna according to claim 1, wherein the first conductor arm is comprised of two conductive elements of identical geometry placed opposite each other on the first and second faces of the substrate.

3. The antenna according to claim 2, wherein the feeder line is placed between the two conductive elements forming a stripline structure.

4. The antenna according to claim 1, wherein the second conductor arm is comprised of two conductive elements of identical geometry placed opposite each other on the first and second faces of the substrate.

5. The antenna according to claim 1, wherein the first and second conductor arms are each constituted by two conductive elements placed opposite each other on the first and second faces of the substrate, and the two conductive elements are connected by holes made to pass through the substrate and filled with conductive material.

6. The antenna according to claim 5, wherein the holes are made on the conductive elements periphery.

7. The antenna according to claim 1, wherein the feeder line is realized by a microstrip line passing below the first conductor arm comprised of a sole conductor element realized on the first face of the substrate, the microstrip line being realized on the second face of the substrate.

8. The antenna according to claim 7, wherein the second conductor arm is formed from a single conductive element realized on the first face of the substrate.

* * * * *